US008440727B2

(12) United States Patent
Gradek

(10) Patent No.: US 8,440,727 B2
(45) Date of Patent: May 14, 2013

(54) HYDROCARBON EXTRACTION BY OLEOPHILIC BEADS FROM AQUEOUS MIXTURES

(76) Inventor: Thomas Gradek, Rosemere (CA)

( * ) Notice: Subject to any disclaimer, the term of this patent is extended or adjusted under 35 U.S.C. 154(b) by 768 days.

(21) Appl. No.: 12/564,111

(22) Filed: Sep. 22, 2009

(65) Prior Publication Data

US 2010/0072110 A1 Mar. 25, 2010

Related U.S. Application Data

(60) Provisional application No. 61/136,791, filed on Oct. 3, 2008.

(30) Foreign Application Priority Data

Sep. 23, 2008 (CA) ..... 2639749

(51) Int. Cl.
*C10G 1/04* (2006.01)

(52) U.S. Cl.
USPC ..... 516/136; 516/137; 516/138; 516/139; 208/188; 210/708

(58) Field of Classification Search ..... 208/188; 516/136–139; 210/708
See application file for complete search history.

(56) References Cited

U.S. PATENT DOCUMENTS

| | | | |
|---|---|---|---|
| 3,399,765 | A | 9/1968 | Puddington et al. |
| 3,968,572 | A | 7/1976 | Stuchberry |
| 4,058,453 | A | 11/1977 | Patel |
| 4,236,995 | A | 12/1980 | Kruyer |
| 4,406,793 | A | 9/1983 | Kruyer |
| 4,511,461 | A | 4/1985 | Kruyer |

FOREIGN PATENT DOCUMENTS

| | | |
|---|---|---|
| CA | 841581 | 5/1970 |
| CA | 918588 | 1/1973 |
| CA | 975697 | 10/1975 |
| CA | 1114498 | 12/1981 |
| CA | 1144498 | 4/1983 |
| CA | 2212447 | 5/2008 |

*Primary Examiner* — Brian McCaig
(74) *Attorney, Agent, or Firm* — McMillan LLP

(57) ABSTRACT

A method and system for recovering fluid (e.g. liquid) hydrocarbons from both naturally-occurring and man-made mixtures of hydrocarbons and mineral substrates by the exploiting of buoyant beads.

25 Claims, 3 Drawing Sheets

HYDROCARBON EXTRACTION BY OLEOPHILIC BEADS FROM AQUEOUS MIXTURES

REFERENCE TO PRIOR APPLICATIONS

Figure 1:
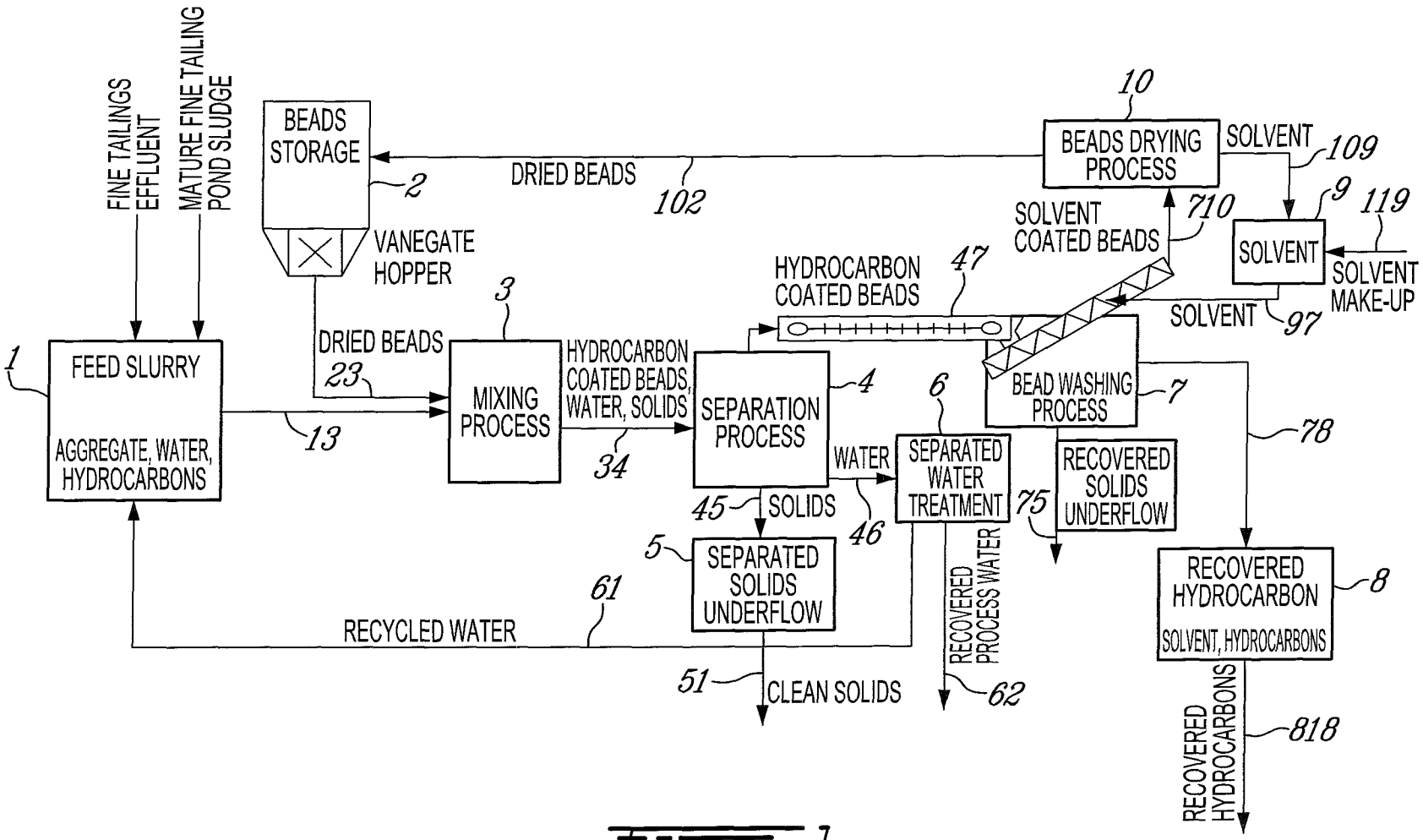

This application claims priority to U.S. Provisional Application No. 61/136,791 filed Oct. 3, 2008, and to Canadian Patent Application No. 2,639,747 filed Sep. 23, 2008.

FIELD OF THE INVENTION

The present invention relates to methods and systems for recovering fluid type (e.g. liquid) hydrocarbons from both naturally-occurring and man-made mixtures of hydrocarbons and mineral substrates; also possibly from mixtures of fluid type (e.g. liquid) hydrocarbons and water (i.e. no mineral substrates) such as, for example, from wastewater comprising hydrocarbonaceous material. In particular, the present invention relates to methods and systems for processing hydrocarbon-containing geologic material or ores (including; tar sands, oil sands, oil sandstones, oil shales) as well as petroleum contaminated soils/and fluids to recover petroleum-like hydrocarbons, and especially bitumen/kerogen/and/or crude oil and/or fractions, therefrom and to render the water and/or mineral substrate residues suitably low in hydrocarbons, for environmentally-acceptable disposal; and most particularly to a method and system for separating bitumen from particulates in tar sand and oil sand-grains, using buoyant oleophilic beads. As used hereinafter, the term "tar sands" shall be taken to mean any or all of the above hydrocarbonaceous material containing ores. As disclosed, for example, in Canadian Patent No. 975,697 issued on Oct. 7, 1975 to Davitt H. James tailing pond contents, referred to as sludge therein, may be a potential source of bitumen.

It is to be understood herein that in relation to the expression "bare oleophilic surface" and the like, such a (bare) surface is to be understood as being a "film free or essentially film free surface" and in particular as being a "surface devoid of or essentially devoid of any hydrocarbon or solvent (outer) film". It is in particular to be understood herein that the expressions "film free or essentially film free surface" and "surface devoid of or essentially devoid of any hydrocarbon or solvent (outer) film" and the like are to be understood as qualifying a (bare oleophilic) surface etc. as being a surface etc. able to be (directly) associated with a hydrocarbonaceous material (for the purposes) as described herein, e.g. without the application or intervention of an intermediate hydrocarbon film or layer being (first) applied to such surface etc. For example such a surface may be a surface which has no film of solvent or if such film of solvent is present, it may be present in essentially not more than 2% solvent weight by weight of the beads and in particular the amount of solvent following the drying stage may, for example, be not more than about 0.5% by weight of solvent by weight of the beads.

In the intended application of attaching hydrocarbonaceous material to the surface of suitable (buoyant) beads, such beads associated with hydrocarbonaceous material may, for example, be made bare of hydrocarbonaceous film by volatilization (e.g. by the exploitation of heat, vacuum, etc, including combinations thereof,) of (all) residual hydrocarbon liquids and/or solvents, and/or by means of centrifuging, and/or by microbial degradation such that the desired oleophilic properties of the beads is (fully) restored, enabling them to be reintroduced to the process as recycled, fresh beads unaltered by any cross-contamination.

As used herein, the terminology "aggregate component" and any similar word(ing) shall be understood as referring to or as characterizing (or emphasizing) a "material", etc. or any portion thereof as a mass of individual particles or elements of the same or varied size (e.g. the size of the particles or elements may or may not be uniform and may range from microscopic granules to 10 cm and larger); it is also to be understood that the particle size distribution of any particular "material", etc. may be different from that of another "material", etc. which is part of an aggregate component".

As used herein, the terminology "aggregate component" and the like shall also be understood as referring to but not limited to superficial earth crust material, whether natural or man made (i.e. unconsolidated mantle, soil, etc.), namely aggregate material including but not limited to

- aggregate material disposed on dry land masses (e.g. soil aggregate material); sedimentary aggregate including any bottom sediments of fresh or marine water systems;
- aggregate material which has an organic matter portion derived for example from tar sands, oil shale, etc.;
- aggregate material derived from human activities, such as, for example, mineral aggregate materials, fill aggregate materials as well as sediments arising in water-ways; etc.

Thus as used herein, the terminology "soil" includes all forms of particulate matter, such as, for example, clay, fines, sand, rock, humus, etc. and in particular for example, soil particles and embankment material particles.

It is to be understood herein that the expression "hydrocarbonaceous material" or the like is a reference to a liquid material; such liquid material may have a low (e.g. 1 centipoise) to (very) high viscosity (e.g. $10^6$ centipoise); e.g. a viscosity in the range of from 10 centipoise to $10^6$ centipoise.

It is further to be understood herein that the expression "hydrocarbonaceous material" or the like is a reference to naturally occurring and/or man-made fluid (i.e. liquid) material including but not limited to hydrocarbon type organic materials. In general, the expression "hydrocarbonaceous material" or the like is to be understood as being a reference to any type of organic material comprising hydrogen and carbon provided that such material is able to be picked-up by the surface of beads as described herein; in particular such materials which are (at least partially) water insoluble or water immiscible. Thus, the expression "hydrocarbonaceous material" or the like is in particular to be understood as being a hydrocarbon type organic material consisting of hydrogen and carbon.

A "hydrocarbonaceous material" may be associated with inorganic type (e.g. mineral type) substrates, which may, for example, constitute in addition to hydrocarbons, oleophilic (solid) particles. Such oleophilic (solid) particles may be organic, and may comprise asphaltenes, low grade coal, kerogen, etc. . . . A "hydrocarbonaceous material" may be found in hydrocarbon-containing geologic material or ores including tar sands, oils sands, oil sandstones, oil shales and petroleum contaminated soils.

It is further understood that the hydrocarbonaceous material recovered (as described herein) from the product beads by the use of a hydrocarbon solvent to recover hydrocarbonaceous material there from (e.g. as a component of a hydrocarbon fluid (i.e. liquid) mixture comprising recovered hydrocarbonaceous material and said hydrocarbon solvent), may be suitable for refining and the amount of hydrocarbon solvent present in the mixture may be such that the viscosity of the hydrocarbonaceous material may be manipulated (e.g.

reduced) so as to provide an API value of at least 12 (e.g. an API of 16 or higher) which is suitable for pipeline transportation to a refinery.

BACKGROUND OF THE INVENTION

Procedures for separating bitumen from mined oil sands are known. A hot water method is for example, disclosed in Canadian Patent No. 841,581 issued May 12, 1979 to Paul H. Floyd, et. al.; in accordance with this patent bituminous sands are jetted with steam and mulled with a minor amount of hot water and sodium hydroxide in a conditioning drum to produce a pulp which passes from the conditioning drum through a screen which removes debris, rocks and oversize lumps to a sump where it is diluted with additional water. It is thereafter carried into a separation cell.

In the separation cell, sand settles to the bottom as tailings which are discarded. Bitumen rises to the top of the cell in the form of a bituminous froth which is called the primary froth product. The froth product may be combined with a hydrocarbon diluent such as naphtha. The resultant mixture may be centrifuged to obtain a final bitumen product that is suitable for refining into a synthetic crude oil.

Various methods for preparing oil sand slurries are also taught in the prior art; see for example Canadian (CA) Patent No. 918,588 issued on Jan. 9, 1973 to Marshall R. Smith, et. al., and U.S. Pat. No. 3,968,572 issued on Jul. 13, 1976 to Frederick C. Stuchberry.

CA 2212447 discloses the use of oleophilic free bodies and a hydrocarbon solvent film applied thereto to collect the oil phase as disclosed in the patent.

It would, for example, be advantageous to have an alternate means for recovery of hydrocarbonaceous material from substances comprising for example different types of (viscous) hydrocarbon oils and mineral particles. It would in particular be advantageous to be able to recover bitumen mixtures such as for example mined tar sand slurries, tar sand tailings, middlings and tailings pond sludge; viscous hydrocarbons deposited on sands or water surfaces as a result of oil spills; oil and water emulsions created by steam injection into tar sands or heavy oil deposits or other oil recovery techniques; mineral deposits in low grade ores mined dry and mixed with water or dredged materials from streams, lakes beds, river bottoms and the like.

The invention in an aspect relates to the use (e.g. reuse) of buoyant beads having a (bare) oleophilic surface able to associate with (i.e. pick-up) hydrocarbonaceous material (e.g. bituminous material) for recovery thereof. Such (bare) oleophilic surface has the advantage of being able to take up a wide range of hydrocarbonaceous material.

Thus, in a particular aspect the present invention relates to the use of buoyant beads having a bare oleophilic surface to recover hydrocarbonaceous material from an aqueous mixture comprising water and hydrocarbonaceous material.

The invention in accordance with another aspect exploits a (hydrocarbon) solvent (e.g. a solvent as described herein—e.g. a substance comprising toluene, xylene, naphtha, hexane, pentane and the like as well as mixtures thereof) to recover hydrocarbonaceous material from product buoyant beads (e.g. as described herein). However, in accordance with a particular feature of this aspect the (hydrocarbon) solvent need, for example, not be (e.g. wholly) separated from the recovered hydrocarbonaceous material for recycling but may instead be used or exploited to perform the function of a diluent component to facilitate pumping of recovered hydrocarbonaceous material to a downstream processing plant or to a storage tank(s) for subsequent transport to such a downstream processing plant (i.e. by pipeline or by tanker truck).

In accordance with the present invention the buoyant beads (or free bodies) may take any suitable or desired form keeping in mind the purpose thereof. Thus the buoyant beads may be in the form of spheres, spheroids, pebbles, teardrops, rods, discs, saddles, or of another shape, simple or complex, which is effective in searching out dispersed phase particles in the mixture. The buoyant beads (e.g. free bodies) may be solid, hollow, or apertured. They are preferably of a smooth non-porous surface. The buoyant beads (e.g. free bodies) may be cast, molded, formed or fabricated in other ways. Oleophilic free bodies may be made with oleophilic materials or they may be made from other materials and then covered with a (solid) layer of an oleophilic material.

Any oleophilic material may be used herein keeping in mind (see below) that the invention in an aspect relates to the use (e.g. reuse) of buoyant beads having a "bare" oleophilic surface able to associate with (i.e. pick-up) hydrocarbonaceous material (e.g. bituminous material) for recovery thereof. Examples of suitable oleophilic materials that may be used in the fabrication of oleophilic buoyant beads of the present invention free bodies are neoprene, urethane, polypropylene, plastics and artificial rubbers, see CA patent 1144498, CA patent 2212447, U.S. Pat. No. 3,399,765, U.S. Pat. No. 4,236,995, U.S. Pat. No. 4,406,793, U.S. Pat. No. 4,511,461, etc.

The use of oleophilic adhesion techniques of the present invention may for example be exploited for recovering bitumen from mined tar sands, for recovering other hydrocarbons from aqueous mixtures (e.g. from wastewater) and for recovering oleophilic surfaced mineral particles.

The present invention in accordance with an aspect thereof provides a method for the recovery (or separation) of hydrocarbonaceous material from water, said hydrocarbonaceous material being a liquid material, said method comprising the steps of:

(a) agitating an aqueous mixture comprising water, said hydrocarbonaceous material and buoyant beads having a bare oleophilic (i.e. film free or essentially film free) surface (e.g. a surface devoid of or essentially devoid of any hydrocarbon or solvent (outer) film, e.g. beads for which at least the (i.e. exposed/outer) surfaces are of oleophilic material) so as to obtain product buoyant beads having hydrocarbonaceous material associated therewith (i.e. buoyant beads to (the (outer) surface of) which hydrocarbonaceous material is adhered); and (b) recovering product buoyant beads.

In accordance with the present invention for step (b) any suitable or desired recovery technique may be exploited for the recovery of the product buoyant beads (i.e. keeping in mind the purpose thereof). Thus, for example, step (b) may comprise a bead flotation step for the recovery of product buoyant beads; step (b) may comprise a screening step whereby product beads are separated (i.e. strained) from other components of the aqueous mixture using suitable screening means; step (b) may as desired comprise a combination of these or other (suitable) recovery techniques.

In accordance with the present invention a method for the recovery (or separation) of hydrocarbonaceous material may as desired or necessary further comprise (c) contacting product buoyant beads from step (b) with a hydrocarbon solvent so as to recover hydrocarbonaceous material therefrom; e.g. so as to recover a hydrocarbon fluid (i.e. liquid) mixture wherein recovered hydrocarbonaceous material is a component thereof along with hydrocarbon solvent. The hydrocarbon solvent in step (c) may for example, comprises at least one compound that is selected from the group consisting of naphtha, toluene, hexane and pentane.

In accordance with the present invention step (c) may also be carried out so as to also obtain solvent washed beads. The recovery method may optionally (or as desired or as necessary) comprise treating solvent washed beads (in any suitable manner) so as to recover buoyant beads having the above mentioned bare oleophilic surface. Such recovered bead may as desired or necessary be recycled for use in step (a) of the recovery method. In other words as may be understood, solvent washed beads (e.g. beads free of the sought after hydrocarbonaceous material) may yet be associated with hydrocarbon solvent. Hence, a method (or system) of the present invention may further comprise (any type of suitable) means (e.g. heating) for separating such (retained) solvent from the solvent washed beads to return the beads to their original (i.e. bare) state, (i.e. devoid of or essentially devoid of any residual hydrocarbon or solvent film) for re-use.

The buoyant beads may be of any suitable material; see above. The buoyant beads may for example be an organic co-polymer. The beads may for example be specifically designed and manufactured for any unique desired characteristics. The polymer of the beads may be a material having suitable oleophilic and buoyancy characteristics keeping in mind the purpose thereof; the beads may as desired also have hydrophobic characteristic. Thus beads may be used which take the form of a (naturally) hydrophobic and oleophilic co-polymer.

In accordance with a particular aspect of the present invention hydrocarbonaceous material may be recovered from a hydrocarbon bearing composition comprising an aggregate component and a hydrocarbon component, the hydrocarbon component comprising hydrocarbonaceous material. The aggregate component, may be as defined herein (i.e. above).

Thus the present invention also relates to a method for the recovery (or separation) of hydrocarbonaceous material from a hydrocarbon bearing composition comprising an aggregate component and a hydrocarbon component, said hydrocarbon component comprising hydrocarbonaceous material, said hydrocarbonaceous material being a liquid material, the method comprising:

(a) agitating an aqueous mixture comprising water, said hydrocarbon bearing composition and buoyant beads having a bare oleophilic (i.e. film free or essentially film free) surface (e.g. a surface devoid of or essentially devoid of any hydrocarbon or solvent (outer) film, e.g. beads for which at least the (i.e. exposed/outer) surfaces are of oleophilic material), so as to obtain product buoyant beads having hydrocarbonaceous material associated therewith;

(b) recovering product buoyant beads; and (c) contacting product buoyant beads from step (b) with a hydrocarbon solvent so as to recover hydrocarbonaceous material therefrom.

In accordance with the present invention a method for the recovery (or separation) of hydrocarbonaceous material from a hydrocarbon bearing composition is provided wherein step (b) thereof may comprise a bead flotation step for the recovery of said product buoyant beads and said product buoyant beads from step (b) may be contacted with a hydrocarbon solvent so as to recover hydrocarbonaceous material therefrom.

In accordance with the present invention a method for the recovery (or separation) of hydrocarbonaceous material from a hydrocarbon bearing composition is provided wherein step (b) thereof may comprise a bead flotation step for the recovery of said product buoyant beads and said product buoyant beads from step (b) may be contacted with a hydrocarbon solvent so as to recover therefrom a liquid hydrocarbon mixture comprising recovered hydrocarbonaceous material and hydrocarbon solvent and so as to obtain solvent washed beads In accordance with the present invention a method for the recovery (or separation) of hydrocarbonaceous material from a hydrocarbon bearing composition is provided wherein the solvent washed beads may be treated to obtain recovered buoyant beads having a bare oleophilic surface and said recovered buoyant beads are recycled to step (a) thereof.

As mentioned above in accordance with the present invention the hydrocarbon solvent in step (c) nay comprise at least one compound that may be selected from the group consisting of naphtha, toluene, hexane and pentane.

In accordance with the present invention the buoyant beads may have a specific gravity in the range of from 0.080 to 0.35.

In accordance with the present invention the buoyant beads may have an average width in the range of from 12 to 20 millimeters.

In accordance with the present invention the buoyant beads may have a specific gravity in the range of from 0.080 to 0.35 and an average width in the range of from 12 to 20 millimeters.

In accordance with another aspect the present invention relates to a system for the recovery of hydrocarbonaceous material from water, said hydrocarbonaceous material being a liquid material, said system comprising:

(a) a mixing vessel for containing an aqueous mixture comprising water, hydrocarbonaceous material and buoyant beads having a bare oleophilic surface (as defined herein)

(b) agitation means for agitating said aqueous mixture in said mixing vessel so as to obtain product buoyant beads having hydrocarbonaceous material associated therewith; and (c) recovery means for recovering product buoyant beads.

A system in accordance with the present invention may comprise recovery means which comprises means for the recovery of product buoyant beads by bead flotation (or any other suitable, desired or necessary technique).

A system in accordance with the present invention may further comprise bead solvent wash means for contacting product buoyant beads with a hydrocarbon solvent so as to recover hydrocarbonaceous material therefrom. A system in accordance with the present invention may in particular further comprise bead solvent wash means for contacting product buoyant beads with a hydrocarbon solvent so as to recover therefrom a liquid hydrocarbon mixture comprising recovered hydrocarbonaceous material and hydrocarbon solvent and so as to obtain solvent washed beads.

A system in accordance with the present invention may further comprise means for treating solvent washed beads to obtain recovered buoyant beads having a bare oleophilic surface (as defined herein).

A system in accordance with the present invention may further comprise means for recycling recovered buoyant beads having a bare oleophilic surface (as defined herein) to the mixing vessel.

The present invention in particular relates to a system for the recovery of hydrocarbonaceous material from a hydrocarbon bearing composition comprising an aggregate component and a hydrocarbon component, said hydrocarbon component comprising hydrocarbonaceous material said hydrocarbonaceous material being a liquid material, said system comprising:

(i) a mixing vessel for containing a mixture comprising water, said hydrocarbon bearing composition and buoyant beads having a bare oleophilic surface (as defined herein);

(ii) agitation means for agitating the mixture in said vessel so as to obtain product buoyant beads having hydrocarbonaceous material associated therewith;

(iii) recovery means for recovering product buoyant beads;

(iv) bead solvent wash means for contacting said recovered product buoyant beads with a hydrocarbon solvent for recovering therefrom a liquid hydrocarbon mixture comprising recovered hydrocarbonaceous material and hydrocarbon solvent and so as to obtain solvent washed beads;

(v) treatment means for treating said solvent washed beads to obtain recovered buoyant beads having a bare oleophilic surface; and (vi) means for recycling recovered buoyant beads having a bare oleophilic surface to said mixing vessel. As mentioned above a recovery means may, for example, comprise means for the recovery of product buoyant beads by bead flotation.

Keeping the above in mind, and alternatively stated, the present invention relates to A) A method for separating hydrocarbons from a hydrocarbon bearing aggregate, the method comprising:

(a) providing a supply of buoyant beads having (bare) surfaces that are oleophilic;

(b) causing said beads, (devoid of or at least essentially devoid of any hydrocarbon or solvent film, to come in (direct) contact with said hydrocarbon bearing aggregate and with water and agitating said mixture causing hydrocarbons contained in said aggregate to adhere to said beads;

(c) allowing said agitated mixture to settle such that said beads with adhered hydrocarbons float to the top of said mixture; and (d) separating the beads from step (c) from said mixture and treating said beads by washing the hydrocarbon coated beads with a solvent to recover the adhered hydrocarbons there from.

B) A system for the recovery (or separation) of hydrocarbonaceous material from a hydrocarbon bearing composition comprising an aggregate component [e.g. an aggregate comprising soil, sands, stone, gravel, clays, etc. including mixtures thereof] and a hydrocarbon component, said hydrocarbon component comprising hydrocarbonaceous material said system comprising:

(i) a mixing vessel for containing a mixture comprising water, said hydrocarbon bearing composition and buoyant beads having an (bare) oleophilic (i.e. film free or essentially film free) surface (e.g. a surface devoid of or essentially devoid of any hydrocarbon or solvent (outer) film, e.g. beads for which at least the surfaces are of oleophilic material);

(ia) means for delivery to said mixing vessel of (a suitable or desired measured quantity of) said aggregate, (a suitable or desired measured quantity of) water, and (a suitable or desired measured quantity of) said buoyant beads,]

(ii) means for agitating the mixture in said vessel so as to obtain product buoyant beads having hydrocarbonaceous material associated therewith (i.e. buoyant beads to (the (outer) surface of) which hydrocarbonaceous material is adhered);

(iii) means for recovering product buoyant beads (e.g. by flotation)

(iiia) means for delivering said recovered product buoyant beads to a solvent wash means for contacting said recovered product buoyant beads with a hydrocarbon solvent for recovering hydrocarbonaceous material from said product buoyant beads (e.g. as a component of a hydrocarbon fluid (i.e. liquid) mixture comprising recovered hydrocarbonaceous material and said hydrocarbon solvent) so as to obtain solvent washed beads;

(iv) means for recovering (or separating) hydrocarbonaceous material and/or solvent (e.g. as a hydrocarbon fluid (i.e. liquid) mixture comprising recovered hydrocarbonaceous material and said hydrocarbon solvent) from said solvent washed beads; and (v) means for treating said solvent washed beads to obtain recovered buoyant beads having an (bare) oleophilic (i.e. film free or essentially film free) surface (e.g. a surface devoid of or essentially devoid of any hydrocarbon or solvent (outer) film, e.g. beads for which at least the surfaces are of oleophilic material); and (va) means for recycling said recovered buoyant beans to said mixing vessel.

C) A system for effecting separation of hydrocarbons from an aggregate mixture in a water slurry in which said hydrocarbons are contained comprising:

(i) a mixing vessel and means for delivery to said mixing vessel a measured quantity of said aggregate, water, and a measured quantity of buoyant beads that have (bare) surfaces of oleophilic material;

(ii) means for agitating the contents of said vessel to ensure thorough mixing and direct contact of said beads with said aggregate, and said water, and to cause direct adherence of said hydrocarbons to said beads;

(iii) means for removing said beads with adhered hydrocarbons thereon (e.g. by flotation) and delivering said beads to a solvent wash;

(iv) means in said solvent wash for removing adhered hydrocarbons from said beads;

(v) means for delivering separated hydrocarbons and solvent from said solvent wash; and (vi) means for separating said solvent from said solvent washed beads produced by said delivery means so that said solvent is available for recycling in said system and said recovered buoyant beads having an (bare) oleophilic (i.e. film free or essentially film free) surface (e.g. a surface devoid of or essentially devoid of any hydrocarbon or solvent (outer) film, e.g. beads for which at least the surfaces are of oleophilic material) and thereby available for re-use in said system.

D) A method for separating a hydrocarbon material from a hydrocarbon containing substance [e.g. originating from a naturally occurring hydrocarbon bearing deposit, from a man-made material or deposit or from wastewater or a mixture thereof] comprising:

(a) agitating a mixture comprising water, said hydrocarbon containing substance and buoyant beads having an (bare) oleophilic (i.e. film free or essentially film free) surface (e.g. a surface devoid of or essentially devoid of any hydrocarbon or solvent (outer) film, e.g. beads for which at least the surfaces are of oleophilic material), so as to obtain product buoyant beads having hydrocarbon material associated therewith (i.e. buoyant beads to (the (outer) surface of) which hydrocarbon material is adhered); and (b) recovering product buoyant beads (e.g. by flotation).

E) A method for separating a hydrocarbon material from a hydrocarbon containing substance [e.g. originating from a naturally occurring hydrocarbon bearing deposit, from a man-made material or deposit or from wastewater or a mixture thereof] comprising:

(a) agitating a mixture comprising water, said hydrocarbon containing substance and buoyant beads having an (bare) oleophilic (i.e. film free or essentially film free) surface (e.g. a surface devoid of or essentially devoid of any hydrocarbon or solvent (outer) film, e.g. beads for which at least the surfaces are of oleophilic material), so as to obtain product buoyant beads having hydrocarbon material associated therewith (i.e. buoyant beads to (the (outer) surface of) which hydrocarbon material is adhered);

(b) recovering product buoyant beads (e.g. by flotation)

(c) contacting recovered product buoyant beads from step (b) with a hydrocarbon solvent to recover hydrocarbon material there from (e.g. as a component of a hydrocarbon fluid (i.e. liquid) mixture comprising recovered hydrocarbon material and said hydrocarbon solvent) and so as to obtain solvent washed beads; and (d) treating said solvent washed beads to obtain recovered buoyant beads having an (bare) oleophilic (i.e. film free or essentially film free) surface (e.g. a surface devoid of or essentially devoid of any hydrocarbon or solvent (outer) film, e.g. beads for which at least the surfaces are of oleophilic material).

F) A method for separating hydrocarbons from substance originating from a naturally occurring hydrocarbon bearing deposit, from a man-made material or deposit or from wastewater or a mixture thereof (e.g. a deposit which is one or more of tar sands, tar sands tailings and/or oil and oil wastes) comprising:

(a) providing a supply of unique, specifically designed and manufactured buoyant beads having (bare) surfaces of oleophilic material;

(b) mixing said beads devoid of or essentially devoid of any hydrocarbon or solvent (outer) film, e.g. beads with said substance and water and agitating said mixture causing direct contact, and thereby adherence, between said beads and hydrocarbons contained therein; and (c) separating the beads from step (b) from said mixture (e.g. by flotation).

G) A system for effecting separation of hydrocarbon material from a hydrocarbon containing substance [originating from a naturally occurring hydrocarbon bearing deposit, from a man-made material or deposit or from wastewater or a mixture thereof], the system comprising:

(i) a mixing vessel for containing a mixture comprising water, said hydrocarbon containing substance and buoyant beads having an (bare) oleophilic (i.e. film free or essentially film free) surface (e.g. a surface devoid of or essentially devoid of any hydrocarbon or solvent (outer) film, e.g. beads for which at least the surfaces are of oleophilic material);

(ii) means for agitating the mixture in said vessel so as to obtain product buoyant beads having hydrocarbon material associated therewith (i.e. buoyant beads to (the (outer) surface of) which hydrocarbon material is adhered); and (iii) means for recovering product buoyant beads (e.g. by flotation).

H) A system for effecting separation of hydrocarbon material from a hydrocarbon containing substance [originating from a naturally occurring hydrocarbon bearing deposit, from a man-made material or deposit or from wastewater or a mixture thereof], the system comprising:

(i) a mixing vessel for containing a mixture comprising water, said hydrocarbon containing substance and buoyant beads having an (bare) oleophilic (i.e. film free or essentially film free) surface (e.g. a surface devoid of or essentially devoid of any hydrocarbon or solvent (outer) film, e.g. beads for which at least the surfaces are of oleophilic material);

(ii) means for agitating the mixture in said vessel so as to obtain product buoyant beads having hydrocarbon material associated therewith (i.e. buoyant beads to (the (outer) surface of) which hydrocarbon material is adhered);

(iii) means for recovering product buoyant beads (e.g. by flotation);

(iiia) means for delivering said recovered product buoyant beads to a solvent wash means for contacting said recovered product buoyant beads with a hydrocarbon solvent for recovering hydrocarbon material from said product buoyant beads (e.g. as a component of a hydrocarbon fluid (i.e. liquid) mixture comprising recovered hydrocarbon material and said hydrocarbon solvent) so as to obtain solvent washed beads;

(iv) means for recovering (or separating) hydrocarbon material and solvent (e.g. as a hydrocarbon fluid (i.e. liquid) mixture comprising recovered hydrocarbonaceous material and said hydrocarbon solvent) from said solvent washed beads; and optionally, if desired or necessary (v) means for treating said solvent washed beads to obtain recovered buoyant beads having an (bare) oleophilic (i.e. film free or essentially film free) surface (e.g. a surface devoid of or at least essentially devoid of any hydrocarbon or solvent (outer) film, e.g. beads for which at least the surfaces are of oleophilic material).

I) A system for effecting separation of hydrocarbons from a substance originating from a naturally occurring hydrocarbon bearing deposit, from a man-made material or deposit or from wastewater or a mixture thereof, the system comprising:

(i) a mixing vessel and means for delivery to said mixing vessel a measured quantity of said substance, water and a measured quantity of said buoyant beads that have (bare) oleophilic surfaces devoid of or at least essentially devoid of any residual hydrocarbon or solvent film;

(ii) means for agitating the contents of said vessel to cause direct contact, and thereby adherence of said hydrocarbons to said beads; and (iii) means for removing said beads (e.g. by flotation) with adhered hydrocarbons thereon from said mixture.

J) A method for separating hydrocarbon material from a combination of water and a hydrocarbon containing substance (e.g. originating from a naturally occurring hydrocarbon bearing deposit, from a man-made material or deposit or from wastewater or a mixture thereof), the method comprising:

(a) admixing buoyant beads having an (bare) oleophilic (i.e. film free or essentially film free) surface (e.g. a surface devoid or at least essentially devoid of any hydrocarbon or solvent (outer) film, e.g. beads for which at least the surfaces are of oleophilic material) with said combination of water and the hydrocarbon containing substance to obtain a bead mixture (b) agitating said bead mixture so as to obtain product buoyant beads having hydrocarbon material associated therewith (i.e. buoyant beads to (the (outer) surface of) which hydrocarbon material is adhered); and (c) recovering product buoyant beads (e.g. by flotation).

K) A method for separating hydrocarbon material from a combination of water and a hydrocarbon containing substance (e.g. originating from a naturally occurring hydrocarbon bearing deposit, from a man-made material or deposit or from wastewater or a mixture thereof), the method comprising:

(a) admixing buoyant beads having an (bare) oleophilic (i.e. film free or essentially film free) surface (e.g. a surface devoid or at least essentially devoid of any hydrocarbon or solvent (outer) film, e.g. beads for which at least the surfaces are of oleophilic material) with said combination of water and the hydrocarbon containing substance to obtain a bead mixture (b) agitating said bead mixture so as to obtain product buoyant beads having hydrocarbon material associated therewith (i.e. buoyant beads to (the (outer) surface of) which hydrocarbon material is adhered);

(c) recovering product buoyant beads (e.g. by flotation)

(d) contacting recovered product buoyant beads from step (c) with a hydrocarbon solvent to recover hydrocarbon material there from (e.g. as a component of a hydrocarbon fluid (i.e.

liquid) mixture comprising recovered hydrocarbon material and said hydrocarbon solvent) and so as to obtain solvent washed beads; and (e) treating said solvent washed beads to obtain recovered buoyant beads having an oleophilic (i.e. film free or essentially film free) surface (e.g. a surface devoid of or at least essentially devoid of any hydrocarbon or solvent (outer) film, e.g. beads for which at least the surfaces are of oleophilic material).

L) A method for separating hydrocarbons from a combination of water and a substance (originating from a naturally occurring hydrocarbon bearing deposit, from a man-made material or deposit or from wastewater or a mixture thereof), the method comprising:

a) providing a supply of buoyant beads having (bare) surfaces of oleophilic material;

(b) mixing said beads with said combination of water and the substance and agitating said mixture causing hydrocarbons contained therein to adhere to said beads; and (c) separating the hydrocarbon coated beads (e.g. by flotation) from step (b) from said mixture.

M) A system for effecting separation of hydrocarbons from a combination of water and a substance originating from a naturally occurring hydrocarbon bearing deposit, from a man-made material or deposit or from wastewater or a mixture thereof the system comprising:

(i) a mixing vessel and means for delivery to said mixing vessel a quantity of said combination of water and said substance and a quantity of buoyant beads that have (bare) surfaces of oleophilic material;

(ii) means for agitating the contents of said vessel to cause direct adherence of said hydrocarbons to said beads; and (iii) means for removing said beads (e.g. by flotation) with adhered hydrocarbons thereon from said mixture.

N) A method of extracting hydrocarbons from water, comprising the steps of:

(a) providing a supply of buoyant beads having (bare) surfaces of oleophilic material;

(b) mixing said beads with said water and agitating said mixture causing hydrocarbons contained in said water to adhere to said beads; and (c) separating the hydrocarbon coated beads (e.g. by flotation) from step (b) from said mixture.

O) A system for effecting separation of hydrocarbons from water in which said hydrocarbons are contained comprising:

(i) a mixing vessel and means for delivery to said mixing vessel a quantity of said water and a quantity of buoyant beads that have (bare) surfaces of oleophilic material;

(ii) means for agitating the contents of said vessel to cause adherence of said hydrocarbons to said beads; and (iii) means for removing said hydrocarbon coated beads (e.g. by flotation) thereon from said mixture.

P) A method for separating hydrocarbons from an oil coated substance selected from a group comprising soil, sands, stone, shale, clays, gravel and mixtures thereof, the method comprising: (a) providing a supply of buoyant beads having (bare) surfaces that are of oleophilic material; (b) mixing said buoyant beads with said soil and with water and agitating said mixture causing hydrocarbons contained in said soil to adhere to said buoyant beads; (c) allowing said agitated mixture to settle such that said buoyant beads with adhered hydrocarbons float to the top of said mixture; and (d) separating the buoyant beads from step (c) from said mixture and treating said buoyant beads with a solvent to recover the adhered hydrocarbons therefrom.

Q) A system for effecting separation of hydrocarbons from a soil in which said hydrocarbons are contained comprising: (i) a mixing vessel and means for delivery to said mixing vessel a measured quantity of said soil, water, and a measured quantity of lightweight buoyant beads that have surfaces of oleophilic material; (ii) means for agitating the contents of said vessel to ensure thorough mixing of said soil, said water, and said buoyant beads, and to cause direct adherence of said hydrocarbons to said beads; (iii) means for removing said beads with adhered hydrocarbon thereon and delivering said beads to a solvent wash; (iv) means in said solvent wash for removing adhered hydrocarbons from said beads; (v) means for delivering separated hydrocarbon and solvent from said solvent wash; and (vi) means for separating said solvent from said solvent washed beads produced by said delivery means so that said solvent is available for recycling in said system and said beads have a clean surface devoid or essentially devoid of any hydrocarbon or solvent (outer) film, and thereby available for re-use in said system.

R) A method of extracting hydrocarbons from water, comprising the steps of: (a) providing a supply of buoyant beads having surfaces of oleophilic material; (b) mixing said beads with said water and agitating said mixture causing hydrocarbons contained in said water to adhere to said beads; and (c) separating the hydrocarbon coated beads from step (b) from said mixture.

and

S) A system for effecting separation of hydrocarbons from water in which said hydrocarbons are contained comprising: (i) a mixing vessel and means for delivery to said mixing vessel a quantity of said water and a quantity of buoyant beads that have surfaces of oleophilic material; (ii) means for agitating the contents of said vessel to cause adherence of said hydrocarbons to said beads; and (iii) means for removing said hydrocarbon coated beads thereon from said mixture.

The present invention may be effectively exploited for recovering (e.g. extracting) hydrocarbon (aceou)s (material) by the use of (naturally/artificially) buoyant oleophilic (hydrophobic polymer) beads. The buoyant beads may be solid, hollow or a cellular core construction with a solid surface. They preferably have a smooth non-porous surface, which exhibits specific surface energetic properties that provides a high affinity for hydrocarbons, low interfacial surface tension with hydrocarbons and a spreading factor closest to zero with hydrocarbons. Examples of suitable oleophilic materials that may be used in the fabrication of oleophilic beads are neoprene, urethane, polypropylene, plastics and artificial rubbers.

The buoyant beads may for example be slurried with water and a soil containing hydrocarbons, e.g. Athabasca Tar Sands, and may be agitated to ensure thorough contact of the soil with the beads, the slurry mixture then being allowed to settle. The effect of this agitation is to cause a certain amount of the hydrocarbon that was contained in the soil to come into contact with the oleophilic surface of the beads and to adhere directly to the beads. Upon the mixture settling out, the beads through their natural buoyancy float to the top of the mixture from where they are removed to recover the adhered hydrocarbons.

Repeated treatment of the soil by this process can result in a very high rate of recovery of the hydrocarbons.

In the case of Athabasca Tar Sands, recovery rates of bitumen in excess of 98% have been achieved. In the case of Fine tailings effluent, 91% and 85% reduction of bitumen and naphtha content was obtained. Furthermore this has been done at temperatures ranging from ambient to 45° C. and without the use of auxiliary chemicals such as caustic soda, hydrogen peroxide or hydrocarbon solvents (as is required in some prior art processes). In the absence of caustic soda, the tailings i.e. the residual soil or sand, settle quickly so that the water can be recycled in a very short timeframe.

The beads which may be used are buoyant (i.e. they may have a specific gravity that is below 0.5 preferably in the range 0.06 to 0.35, most preferably from 0.08 to 0.25) and are preferably of substances which are naturally hydrophobic and oleophilic and display good compression strength and resistance to abrasion.

The beads can be of any suitable composition that will provide the required buoyancy and adequate durability. For example they could comprise hollow bodies of e.g. ceramic or metal, coated with a continuous layer of oleophilic and hydrophobic material. However, preferably the beads are of a homogeneous organic polymer material as described in the preceding paragraph.

The beads used in the examples hereinafter set forth were of low density and of roughly spherical shape with an average diameter of about 17 mm, there being approximately 1500 beads per kilogram weight. The beads should not be too small since if they are they would not provide sufficient buoyancy to effect floatation when coated with adhered bitumen and any contained soil; that is the surface area to volume ratio would be too high.

Accordingly, it is preferred that the beads have a size in the range 12 to 20 mm and a specific gravity in the range 0.080 to 0.35.

The beads may be of various shapes, e.g. spherical, roughly spherical, or egg shaped. While round or roughly spherical beads may be preferable, the shape of the beads is critical, as it must not comprise of any high energy points which are generated by sharp edges or ridges on the surface.

The (hydrocarbon) solvents which may be exploited in accordance with the present invention may for example be of aliphatic materials low in aromatic content. (Hydrocarbon) Solvents are to be preferred which (for example) have a tendency to dissolve the bitumen so that it can wash off more readily from the polymer bead surface. Low boiling point solvents are preferable since with these the evaporation and condensation of the solvent in the process will require little energy. A solvent may for example be of an aliphatic material such as an alkane-solvent (hydrocarbon) type material (such as for example naphtha, pentane and hexane; in particular naphtha).

The amount of solvent employed will vary depending upon the type and solvency strength.

The method of the present invention offers a number of advantages as follows:

(a) no solvent is required than would be the case in a conventional solvent extraction process, (b) the process does not require the application of heat, but rather can be carried out at normal atmospheric temperatures, and at temperatures ranging from as low as 0° C., to 60° C. thus reducing the cost of heating the water and hydrocarbon source material as had previously been required;

(c) after mixing and separation of the beads, the contained solids settle in the water in a matter of hours (rather than months or years as is the case with some existing processes);

(d) since the solids settle quickly the water can be recycled in the process rather than sent to a tailings pond for extended settling periods;

(e) the hydrocarbon depleted soils can be sufficiently cleansed for reclamation; and (f) the method can provide hydrocarbon recoveries, which exceeds existing processes without the need to add chemicals such as caustic soda which would create further downstream pollution problems.

Figure 2:
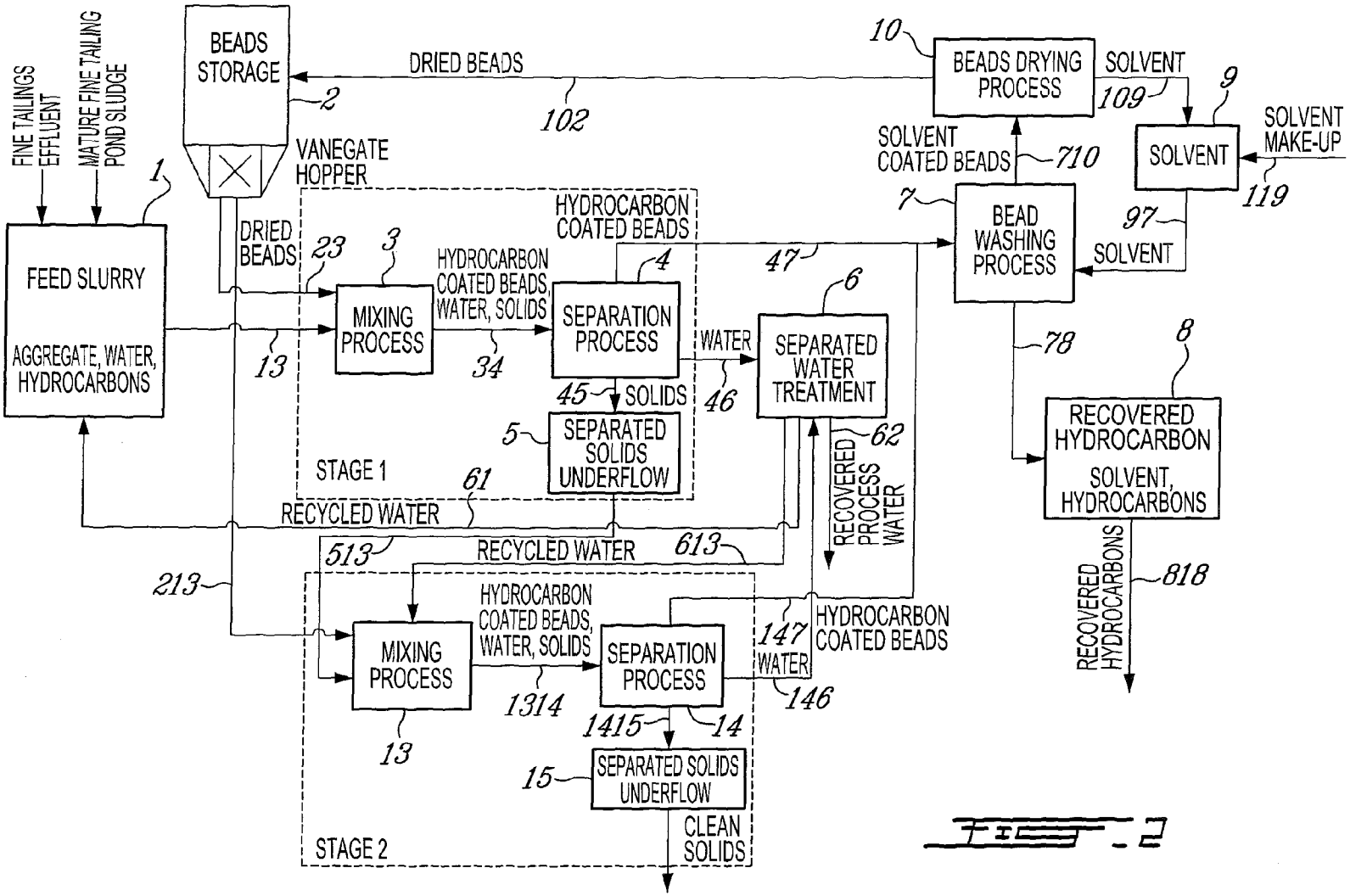
Figure 3:
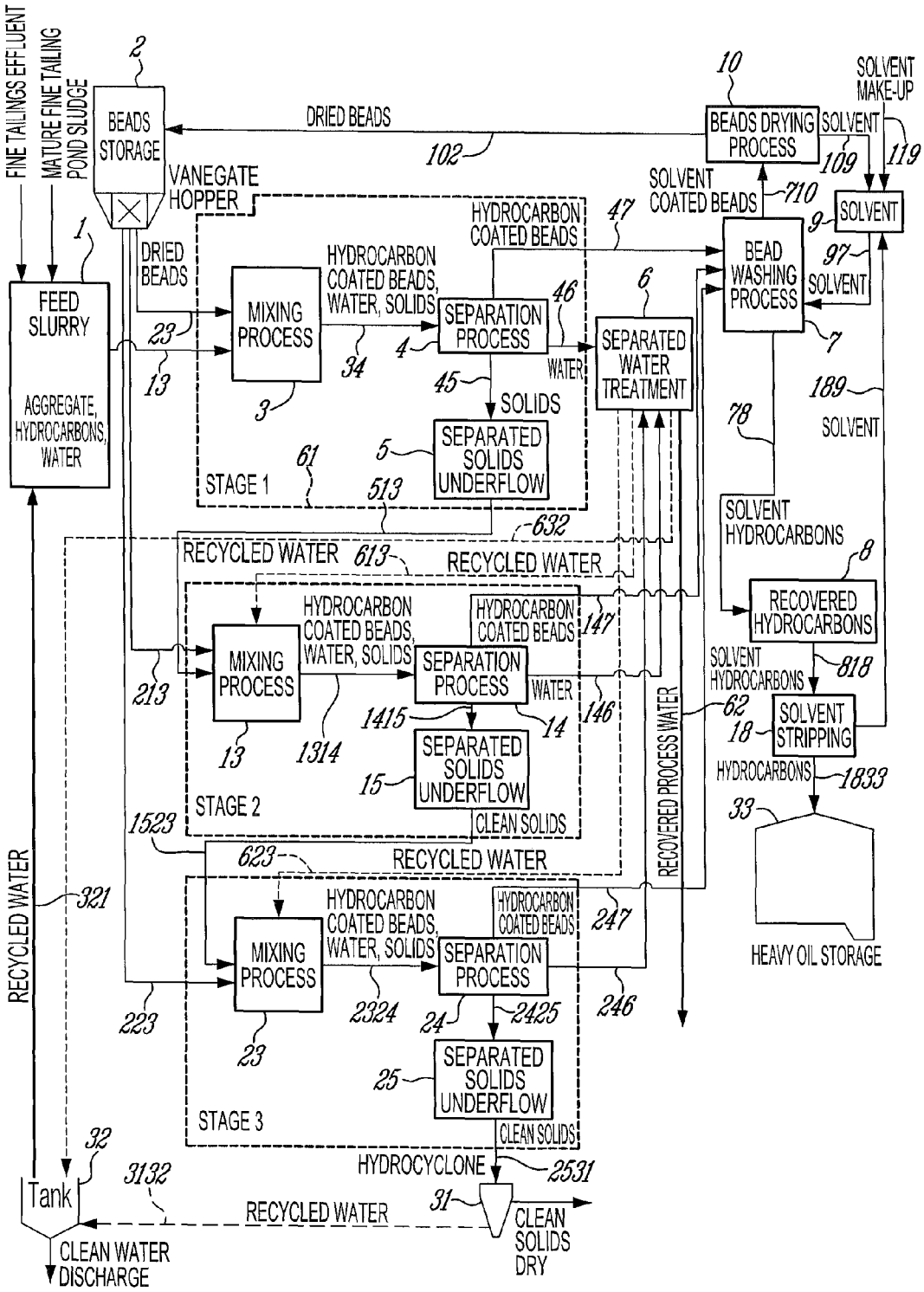

The invention will further be described, by way of example only, with reference to the accompanying figures wherein FIG. 1 is a schematic representation of an example hydrocarbon recovery system in accordance with the present invention having a single mixing/separation stage;

FIG. 2 is a schematic representation of another example hydrocarbon recovery system in accordance with the present invention having two mixing/separation stages; and FIG. 3 is a schematic representation of a further example hydrocarbon recovery system in accordance with the present invention having three mixing/separation stages.

In the FIG. 1 (1 stage), the base material which in the example herein disclosed is Athabasca oil sands fine tailings effluent and mature fine tailing pond sludge, is mixed in a mixing vessel 1 to homogenize the blending of the 2 streams and may involve the addition of water indicated by line 61 which is recycled from the water treatment vessel 6 comprising a dynamic sand filtration unit. The blended streams are delivered to mixer 3 as shown by line 13 which measures a specific flow rate of slurry.

In the vessel 3 the oil sands tailings/water mixture is further mixed with a measured quantity of said buoyant beads which are in the bead storage vessel 2 are delivered as indicated by line 23. In the example disclosed the beads are molded polymer beads, being roughly of rounded shape.

In the mixer vessel 3 the mixture of oil sands, water and buoyant beads is thoroughly agitated by a paddle mixer which may comprise of a single or more shafts onto which are fixed perpendicular to the shaft, perforated paddles of such means and dimensions as to seat the buoyant beads, during their immersion into the aqueous mixture. The rotational speed of the mixer shafts are within the range of 40-150 rpm. For a duration of between 1 and 10 minutes, the beads are swept throughout the downward sweep of the paddle in the rotation through the slurry to effect contact with the hydrocarbon coated particles and hydrocarbons in suspension. Hence by seating the beads into the paddles we are able to obtain a prolonged contact time. During this agitation it has been found that hydrocarbons are extracted from the oil sand particles in the mixture and become adhered to the beads.

The beads and slurry during agitation are being displaced along the length of the mixer towards the other end where the contents of the vessel 3 flow through an aperture and are displaced to a settling vessel 4 as indicated by line 34 and are allowed to separate, whereby during this process the coated beads with adhered hydrocarbons float to the top, and sand and other heavier constituents sinking to the bottom and separated from the beads by a layer of water.

The recovered solids are moved to the solids underflow vessel or tank 5 by line 45 plus the water which is directed to the filtration vessel 6 by the line 46 following which some of the water may be returned to the primary blending vessel 1 via line 61 and the remaining recovered process water can be returned for use as process water in the upstream operations via line 62. The hydrocarbon coated beads are then removed from the vessel 4 and delivered by a conveyor as indicated by the line 47 to a bead washing vessel 7. In the vessel 7 the beads are treated with a hydrocarbon solvent (e.g. naphtha) which removes the adhered hydrocarbons (together with any contained oleophilic soil solids). In the vessel 7 the beads with adhered hydrocarbons are delivered into a reception compartment stage in which the hydrocarbon coated beads are then conveyed on an incline and subjected to a counter-flow wash of solvent in a rotating, internally ribbed, perforated inclined trumel which incorporates wash spray heads directing solvent onto the beads which are transported upwards in the ribbed trumel (solvent being supplied through a line 97 from a solvent tank 9) for a duration (slightly) less than the agitation that occurs in the mixing vessel 3. The liquid contents of the bead washing vessel 7 are distinctly separated with the solvent-recovered hydrocarbon layer floating as the top layer above a water layer. The beads which end up solvent coated during this wash stage are allowed to drip dry as they reach the top section of the inclined trumel and the washed beads (which have a layer of solvent that may still contain minor amounts of dissolved oil/hydrocarbons) therefrom are delivered via line 710 to a dryer unit also known as a solvent extractor vessel 10. For example, any solvent on the surface of the beads may be stripped from the beads during the drying process by being subjecting the solvent coated beads to appropriate temperature and pressure conditions (e.g. partial vacuum) for the solvent being used. The hydrocarbon layer consisting of recovered hydrocarbons and solvent is transferred to the storage tank 8 by the line 78 for further processing. As desired or necessary additional (i.e. make-up) solvent may be added to the solvent tank 9 (via line 119 to make-up for any solvent passing on to storage tank 8. The (pumpable) solvent/recovered hydrocarbon mixture in tank 8 may be sent via conduit 818 to a pipeline or by tanker truck or by tanker rail car to a further processing plant.

The beads from the dryer unit 10 are transferred to the bead storage vessel 2 by line 102 following the removal of the solvent which has restored the bead surface back to its original condition such that it is clean, bare of hydrocarbonaceous film which would otherwise interfere with the surface energetics of the bead in relation to targeted hydrocarbons in the mixing vessel 3 during agitation as described above so as to remove the majority of the hydrocarbons from the feedstock delivered from vessel 1.

As shown in FIG. 1, the beads are moved successively from left to right from bead storage vessel 2 to the mixer vessel 3 then to the separation vessel 4, to the bead washing vessel 7 and to the bead dryer unit 10 to be recycled into the bead storage vessel 2.

Water passing through the mixer vessel 1, onto mixer vessel 3, then to the separation vessel 4 and after separation by settling is delivered to the water treatment vessel 6 and can be recycled to the mixer 1 by line 61 or is redirected to other usage by line 62.

The cleaned sand and soil and the like from the separation vessel 5 will have a very low content of hydrocarbons and may be sent to a landfill site or the like for reclamation by line 51.

The mixing vessel 1 in which the oil sand material is first mixed with water may be supplied with water as indicated by the line 61 if need be. The water in treatment vessel 6 is water recovered from the separation vessel 4.

Referring to FIG. 2 (2 stage), the same reference numerals as mentioned for FIG. 1 are used to refer to the same elements as in FIG. 1. If the desired amount (e.g. all) of the hydrocarbon material is not removed from the oil sands in a (1 Stage Process) comprising a single agitating cycle with mixer vessel 3, it is contended to add an additional series of mixing/separation process cycles as deemed necessary in staging an additional mixer vessel 13, separation vessel 14 and separated solids underflow vessel 15 as an additional modular processing step, for a 2 Stage Process. This setup will comprise of the items that are described in the 1 Stage Process (including as desired or necessary additional (i.e. make-up) solvent may be added to the solvent tank 9 (via line 119), i.e. to make-up for any solvent passing on to storage tank 8) along with this additional modular stage, that will process a slurry that will be made up of a measured quantity of solids from the separated solids underflow vessel 5 and delivered to the additional mixer vessel 13 as indicated by the line 513 and a measured quantity of water from the separated water treatment vessel 6 as indicated by the line 613, with a measured quantity of said buoyant beads from beads storage vessel 2 delivered as indicated by line 213, all of which are delivered to an additional mixer vessel 13 for an agitation cycle. The beads and slurry during agitation are being displaced along the length of the mixer towards the end, where the contents of the vessel 13 flow through an aperture and are displaced to a settling vessel 14 as indicated by line 1314 and are allowed to separate, whereby during this process the coated beads with adhered hydrocarbons float to the top, and sand and other heavier constituents sinking to the bottom and separated from the beads by layer of water.

The recovered water from the separation vessel 14 is transferred to the separated water treatment vessel 6 by line 146 and the hydrocarbon coated beads are then removed from the vessel 14 and delivered as indicated by the line 147 to a bead washing vessel 7. Solids pass via line 1415 to solids underflow vessel or tank 15.

In the vessel 7 the hydrocarbon coated beads are treated with a hydrocarbon solvent which removes the adhered hydrocarbons (together with any contained oleophilic soil solids). In the vessel 7 the beads with adhered hydrocarbons are delivered into a reception compartment stage in which the hydrocarbon coated beads are then conveyed on an incline and subjected to a counter-flow wash of solvent in a rotating, internally ribbed, perforated inclined trumel which incorporates wash spray heads directing solvent onto the beads which are transported upwards in the ribbed trumel the beads with adhered hydrocarbons are agitated with solvent (supplied through a line 97 from a solvent tank 9) for a duration (slightly) less than the agitation that occurs in the mixing vessels (3, 13). The liquid contents of the bead washing vessel 7 are distinctly separated with the solvent-recovered hydrocarbon layer floating as the top layer above a water layer. The beads which end up solvent coated during this wash stage are allowed to drip dry as they reach the top section of the inclined trumel and the washed beads (which have a layer of solvent that may still contain minor amounts of dissolved oil/hydrocarbons) therefrom are delivered via line 710 to a dryer unit also known as a solvent extractor vessel 10. The hydrocarbon layer consisting of recovered hydrocarbons and solvent is transferred to the storage tank 8 by the line 78 for further processing. As desired or necessary additional (i.e. make-up) solvent may be added to the solvent tank 9 (via line 119), i.e. to make-up for any solvent passing on to storage tank 8. The (pumpable) solvent/recovered hydrocarbon mixture in tank 8 may be sent via conduit 818 to a pipeline or by tanker truck or by tanker rail car to a further processing plant.

The beads from the dryer unit 10 are transferred to the bead storage vessel 2 by line 102 following the removal of the solvent which has restored the bead surface back to its original condition in that it is, bare of hydrocarbonaceous film.

If an additional stage (see FIG. 3) is required to further remove bitumen from the solids from the separated solids underflow vessel 15, then in addition to the above configuration, another stage comprising of an additional series of mixing/separation process cycles as deemed necessary by staging an additional mixer vessel 23, separation vessel 24 and separated solids underflow vessel 25 as an additional modular processing step, for a 3 Stage Process.

The 3 stage setup shown in FIG. 3 may comprise the items that are described in the 2 Stage Process (including as desired or necessary additional (i.e. make-up) solvent may be added to the solvent tank 9 (via line 119), i.e. to make-up for any solvent passing on to storage tank 8) along with this additional modular stage, that will process a slurry that will be made up of a measured quantity of solids from the separated solids underflow vessel 15 whereby such measured quantity of solids are delivered to an additional mixer vessel 23 by means of line 1523 and a measured quantity of water is delivered from separated water vessel 6 by line 623, with a measured quantity of said buoyant beads delivered as indicated by line 223 from beads storage vessel 2 are delivered to an additional mixer vessel 23 for an agitation cycle. The beads and slurry during agitation are being displaced along the length of the mixer towards the end, where the contents of the vessel 23 flow through an aperture and are displaced to a settling vessel 24 as indicated by line 2324 and are allowed to separate, whereby during this process the coated beads with adhered hydrocarbons float to the top, and sand and other heavier constituents sinking to the bottom and separated from the beads by layer of water. The recovered water from the separation vessel 24 is transferred to the separated water treatment vessel 6 by line 246 and the hydrocarbon coated beads are then removed from the vessel 24 and delivered as indicated by the line 247 to a bead washing vessel 7.

In the vessel 7 the hydrocarbon coated beads are treated with a hydrocarbon solvent which removes the adhered hydrocarbons (together with any contained oleophilic soil solids). In the vessel 7 the beads with adhered hydrocarbons are delivered into a reception compartment stage in which the hydrocarbon coated beads are then conveyed on an incline and subjected to a counter-flow wash of solvent in a rotating, internally ribbed, perforated inclined trumel which incorporates wash spray heads directing solvent onto the beads which are transported upwards in the ribbed trumel. The beads with adhered bitumen are agitated with solvent (supplied through a line 97 from a solvent tank 9) for a duration slightly less than the agitation that occurs in the mixing vessels (3, 13, 23). The liquid contents of the bead washing vessel 7 are distinctly separated with the solvent-recovered hydrocarbon layer floating as the top layer above a water layer. The beads which end up solvent coated during this wash stage are allowed to drip dry as they reach the top section of the inclined trumel and the beads therefrom are advanced to a bead dryer via line 710 also known as a solvent extractor vessel 10. The hydrocarbon layer consisting of recovered hydrocarbons and solvent is transferred to the storage tank 8 by the line 78 for further processing. In terms of further processing it may be suitable to pre-treat the recovered hydrocarbon/solvent solution that is in tank 8 so as to adjust the solvent concentration in order to meet the pipeline specs of the refinery. This may involve stripping naphtha from the recovered hydrocarbons by transferring to vessel 18 the hydrocarbons by line 818, recovering the solvent and transferring to the solvent storage vessel 9 by line 189 and then pipeline the hydrocarbons from vessel 18 by line 1833 onto an oil storage facility illustrated by vessel 33.

From the vessel 7, the beads therefrom (the washed beads which have a layer of solvent that may still contain minor amounts of dissolved oil/hydrocarbons) are delivered via the line 710 to a dryer unit also known as a solvent extractor vessel 10. The beads from the dryer unit 10 are transferred to the bead storage vessel 2 by line 102 following the removal of the solvent which has restored the bead surface back to its original condition in that it is, bare of hydrocarbonaceous film.

In this way, under suitable circumstances successive cycles have removed up to 99% of the hydrocarbons contained in the oil sands, the resulting cleaned soil material from the separation vessel 25 will have a very low content of hydrocarbons and may be sent to a landfill site or the like for reclamation. Solids pass via line 2425 to solids underflow vessel or tank 25. If required it may be advantageous to remove further entrained water from the recovered clean sands by means of a hydrocyclone 31 which is fed by line 2531. The resulting product will comprise a free flowing tan coloured granular material with a very low hydrocarbon content and virtually no solvent content. The recovered water from the hydrocyclone can be transferred into a water tank 32 by line 3132 and supplement the recycled water volume that may be required in vessel 1.

With a single agitation cycle lasting from 1-10 minutes in the mixer vessel 3 it has been found possible to remove as much as 87% of the bitumen from the high grade oil sands at a temperature of 20° C. and 72% bitumen for low grade of ore.

Recovery rates are dependent upon a number of factors as will be discussed more fully below:

(a) Base Material

This may comprise various forms of oil sands, oil sands effluent, hydrocarbonaceous shales, heavy oils, produced oil field wastes, refinery slop, wastewater, tanks bottom sludges and various types of soil which may have been contaminated e.g. as a result of spillages of hydrocarbon or natural seepages of hydrocarbon.

(b) Solvent

The process can be operated with various solvents for extracting hydrocarbon material such as bitumen or crude oil from the buoyant bead material. Preferred solvents are hydrocarbons which are available at relatively low costs from an oil refinery, examples being preferably naphtha, pentane and hexane. For bitumen recovery it has been found that solvents which are lower in aromatics (naphtha i.e. Shellsol) are preferable since they tend to have a good solvency towards the bitumen and cause it to wash off the bead. Lower boiling point solvents are preferable as less energy is required to flash off the solvent and recycle the solvent in the process.

(c) Solvent Quantity

The optimum quantity of solvent used will depend upon the solvent type and also on the type of material being extracted. In practice the amount of solvent used has been determined by allowing the solvent coated beads to drain naturally in a perforated container for a period in the order of 5-15 minutes. It has also been demonstrated that a fine spray at low pressure will dissolve the hydrocarbon coating very rapidly, thereby reducing the residence time period. In these circumstances it would be expected that the beads would retain more of the higher viscosity solvents as the solvent layer thickness would increase with viscosity. The ratio of solvent weight to the weight of the beads following the wash process has been determined to be varying with viscosity from about 2% to 11% by weight. Preferably the amount of solvent following the drying stage should be not more than about 0.5% by weight of the beads.

(d) Temperature.

The optimum temperature for extraction can be determined by experimentation. For extraction of bitumen containing oil sands, evaluations were made by conducting agitation in the mixer vessel 3 at different temperatures. For a single agitation cycle the following results were obtained:

| Agitation Temperature ° C. Agitation Temperature | Percentage (by weight) of Bitumen Extracted from oil sands Percentage of Bitumen Extracted |
|---|---|
| 20° | 87 |
| 40° | 99 |

In a pilot plant system of apparatus for carrying out the invention applicant has used a twin shaft mixer machine designed by BHS Gmbh. This machine has six paddles on each shaft which rotate counter to each other in the direction of rotating from the center outwards to the sidewalls of the mixer body, having a capacity of about 200 liters and being equipped with an electronic speed control that operates at speeds in the range 40-150 rpm. About 12 kilograms of oil sands with approximately 10% hydrocarbonaceous material and various amounts of beads were added to the mixer together with approximately 80 liters of 30° C. water and agitated for times ranging between 5 minutes and 30 minutes. At the end of agitation the coated beads were scooped from the top of the mixer and the remaining slurry discharged from the bottom of the mixer.

The resulting residual hydrocarbon concentration of the sand was below 100 ppm and the residual hydrocarbon concentration in the processed water was below 15 ppm.

Similar testing on tailing pond sludges with an initial concentration of 21,000 ppm that were mixed with water to a final temperature of 35° C. resulted in residual hydrocarbon levels of <1100 ppm in the solids and residual hydrocarbon concentration in the process tailing water <402 ppm.

In a similar test conducted at a temperature of 42° C., on produced sand from heavy oil operations with an initial concentration of 25,000 ppm, the resulting residual hydrocarbon concentration of the sand was below 100 ppm and the residual hydrocarbon concentration in the processed water was below 1 ppm.

Although that which is described in the foregoing, is solely in relation to the recovery of hydrocarbons from soils, it will be understood that other applications are envisaged for the invention. For example it is believed that the use of the oleophilic beads as described above would be effective for removing oil from oil polluted waters, when the beads are in contact with the oil/water mixture. Likewise the invention could be used for recovering hydrocarbons from oily wastes from oil production operations such as produced sand.

The invention claimed is:

1. A method for the recovery of hydrocarbonaceous material from water, said hydrocarbonaceous material being a liquid material, said method comprising the steps of: (a) agitating an aqueous mixture comprising water, said hydrocarbonaceous material and buoyant beads having a bare oleophilic surface so as to obtain product buoyant beads having hydrocarbonaceous material associated therewith; and (b) recovering product buoyant beads.

2. A method as defined in claim 1 wherein step (b) comprises a bead flotation step for the recovery of said product buoyant beads.

3. A method as defined in claim 1 further comprising (c) contacting product buoyant beads from step (b) with a hydrocarbon solvent so as to recover hydrocarbonaceous material therefrom.

4. The method of claim 3 wherein said hydrocarbon solvent in step (c) comprises at least one compound that is selected from the group consisting of naphtha, toluene, hexane and pentane.

5. The method of claim 1 wherein said beads have a specific gravity in the range of from 0.080 to 0.35.

6. The method as claimed in claim 1 wherein said beads have an average width in the range of from 12 to 20 millimeters.

7. The method as claimed in claim 1 wherein said beads have a specific gravity in the range of from 0.080 to 0.35 and wherein said beads have an average width in the range of from 12 to 20 millimeters.

8. A method for the recovery of hydrocarbonaceous material from a hydrocarbon bearing composition comprising an aggregate component and a hydrocarbon component, said hydrocarbon component comprising hydrocarbonaceous material, said hydrocarbonaceous material being a liquid material, the method comprising: (a) agitating an aqueous mixture comprising water, said hydrocarbon bearing composition and buoyant beads having a bare oleophilic surface, so as to obtain product buoyant beads having hydrocarbonaceous material associated therewith; (b) recovering product buoyant beads; and (c) contacting product buoyant beads from step (b) with a hydrocarbon solvent so as to recover hydrocarbonaceous material therefrom.

9. A method as defined in claim 8 wherein step (b) comprises a bead flotation step for the recovery of said product buoyant beads and said product buoyant beads from step (b) are contacted with a hydrocarbon solvent so as to recover hydrocarbonaceous material therefrom.

10. A method as defined in claim 8 wherein step (b) comprises a bead flotation step for the recovery of said product buoyant beads and said product buoyant beads from step (b) are contacted with a hydrocarbon solvent so as to recover therefrom a liquid hydrocarbon mixture comprising recovered hydrocarbonaceous material and hydrocarbon solvent and so as to obtain solvent washed beads.

11. A method as defined in claim 10 and wherein said solvent washed beads are treated to obtain recovered buoyant beads having a bare oleophilic surface and said recovered buoyant beads are recycled to step (a).

12. The method of claim 11, said hydrocarbon solvent in step (c) comprises at least one compound that is selected from the group consisting of naphtha, toluene, hexane and pentane.

13. The method as claimed in claim 12 wherein said beads have a specific gravity in the range of from 0.080 to 0.35 and wherein said beads have an average width in the range of from 12 to 20 millimeters.

14. The method of claim 8, said hydrocarbon solvent in step (c) comprises at least one compound that is selected from the group consisting of naphtha, toluene, hexane and pentane.

15. The method of claim 8 wherein said beads have a specific gravity in the range of from 0.080 to 0.35.

16. The method as claimed in claim 8 wherein said beads have an average width in the range of from 12 to 20 millimeters.

17. A system for the recovery of hydrocarbonaceous material from water, said hydrocarbonaceous material being a liquid material, said system comprising: (a) a mixing vessel containing an aqueous mixture comprising water, hydrocarbonaceous material and buoyant beads having a bare oleophilic surface (b) agitation means for agitating said aqueous mixture in said mixing vessel so as to obtain product buoyant beads having hydrocarbonaceous material associated therewith; and (c) recovery means for recovering product buoyant beads.

18. A system as defined in claim 17 said recovery means comprises means for the recovery of said product buoyant beads by bead flotation.

19. A system as defined in claim 17 further comprising bead solvent wash means for contacting product buoyant beads with a hydrocarbon solvent so as to recover hydrocarbonaceous material therefrom.

20. A system as defined in claim 17 further comprising bead solvent wash means for contacting product buoyant beads with a hydrocarbon solvent so as to recover therefrom a liquid hydrocarbon mixture comprising recovered hydrocarbonaceous material and hydrocarbon solvent and so as to obtain solvent washed beads.

21. A system as defined in claim 20 further comprising means for treating solvent washed beads to obtain recovered buoyant beads having a bare oleophilic surface.

22. A system as defined in claim 21 further comprising means for recycling said recovered buoyant beads having a bare oleophilic surface to said mixing vessel.

23. A system as defined in claim 22 said recovery means comprises means for the recovery of said product buoyant beads by bead flotation.

24. A system for the recovery of hydrocarbonaceous material from a hydrocarbon bearing composition comprising an aggregate component and a hydrocarbon component, said hydrocarbon component comprising hydrocarbonaceous material, said hydrocarbonaceous material being a liquid material, said system comprising: (i) a mixing vessel for containing a mixture comprising water, said hydrocarbon bearing composition and buoyant beads having a bare oleophilic surface; (ii) agitation means for agitating the mixture in said vessel so as to obtain product buoyant beads having hydrocarbonaceous material associated therewith; (iii) recovery means for recovering product buoyant beads; (iv) bead solvent wash means for contacting said recovered product buoyant beads with a hydrocarbon solvent for recovering therefrom a liquid hydrocarbon mixture comprising recovered hydrocarbonaceous material and hydrocarbon solvent and so as to obtain solvent washed beads; (v) treatment means for treating said solvent washed beads to obtain recovered buoyant beads having a bare oleophilic surface; and (vi) means for recycling recovered buoyant beads having a bare oleophilic surface to said mixing vessel.

25. A system according to claim 24, wherein said agitation means comprises a paddle mixer having one or more shafts having one or more perforated paddles extending therefrom, wherein said buoyant beads rest in said one or more perforated paddles.

* * * * *